US011083252B2

(12) United States Patent
Fleming et al.

(10) Patent No.: US 11,083,252 B2
(45) Date of Patent: Aug. 10, 2021

(54) FASTENING TAPE WITH REINFORCED HOOKS

(71) Applicant: YKK Corporation, Tokyo (JP)

(72) Inventors: Michael Fleming, Macon, GA (US); Wolfgang Coronel, Macon, GA (US); Tsuyoshi Minato, Kurobe (JP)

(73) Assignee: YKK Corporation, Tokyo (JP)

( * ) Notice: Subject to any disclaimer, the term of this patent is extended or adjusted under 35 U.S.C. 154(b) by 0 days.

(21) Appl. No.: 16/136,184

(22) Filed: Sep. 19, 2018

(65) Prior Publication Data

US 2019/0090595 A1 Mar. 28, 2019

Related U.S. Application Data

(60) Provisional application No. 62/561,805, filed on Sep. 22, 2017.

(51) Int. Cl.
*A44B 18/00* (2006.01)

(52) U.S. Cl.
CPC ..... *A44B 18/0061* (2013.01); *A44B 18/0049* (2013.01); *A44B 18/0076* (2013.01)

(58) Field of Classification Search
CPC ..... A44B 18/0061; A44B 18/0049; A44B 18/0076
See application file for complete search history.

(56) References Cited

U.S. PATENT DOCUMENTS 5,131,119 A 7/1992 Murasaki et al.
5,339,499 A 8/1994 Kennedy et al.
5,537,720 A * 7/1996 Takizawa ..... A44B 18/0061 24/452
5,551,130 A 9/1996 Tominaga et al.
5,657,517 A 8/1997 Akeno et al.
5,664,301 A 9/1997 Akeno
5,692,271 A * 12/1997 Provost ..... A44B 18/0049 24/452

(Continued)

FOREIGN PATENT DOCUMENTS

JP H07-079814 A 3/1995
JP H08-205910 A 8/1996

(Continued)

OTHER PUBLICATIONS

Office Action, Korean Patent Application No. 10-2018-0112819, dated Nov. 26, 2019, 18 pages.

(Continued)

*Primary Examiner* — Robert Sandy
*Assistant Examiner* — Michael S Lee
(74) *Attorney, Agent, or Firm* — Kilpatrick Townsend & Stockton LLP

(57) ABSTRACT

A fastening tape includes a base, at least one hook, and at least one rib. The at least one hook includes a stem and an engagement portion extending from an upper end of the stem in a longitudinal direction. The stem includes a leading edge and a trailing edge in the longitudinal direction, and a center of the at least one hook is between the leading edge and the trailing edge. The at least one rib is laterally adjacent to the at least one hook, and a center of the at least one rib is offset from the center of the at least one hook in the longitudinal direction towards the leading edge of the stem.

13 Claims, 8 Drawing Sheets

(56) References Cited

U.S. PATENT DOCUMENTS

| | | | | |
|---|---|---|---|---|
| 5,860,194 | A | 1/1999 | Takizawa et al. | |
| 5,930,876 | A | 8/1999 | Takizawa et al. | |
| 6,061,881 | A * | 5/2000 | Takizawa | A44B 18/0061 24/446 |
| 6,656,563 | B1 | 12/2003 | Leach et al. | |
| 6,960,314 | B2 | 11/2005 | Lacey et al. | |
| 7,053,649 | B1 | 5/2006 | Osada | |
| 7,520,033 | B2 | 4/2009 | Clarner | |
| 7,716,792 | B2 | 5/2010 | Clarner | |
| 2002/0022108 | A1* | 2/2002 | Krantz | A44B 18/0049 428/100 |
| 2003/0034583 | A1 | 2/2003 | Provost | |
| 2004/0103503 | A1 | 6/2004 | Leach et al. | |
| 2004/0108620 | A1 | 6/2004 | Leach et al. | |
| 2004/0187276 | A1 | 9/2004 | Seth et al. | |
| 2004/0194262 | A1* | 10/2004 | Kurtz, Jr. | A44B 18/0061 24/452 |
| 2006/0019059 | A1 | 1/2006 | Seth et al. | |
| 2006/0202923 | A1 | 9/2006 | Osada | |
| 2017/0008435 | A1* | 1/2017 | Murasaki | A44B 18/0049 |
| 2018/0072465 | A1* | 3/2018 | Cheng | A44B 18/0049 |

FOREIGN PATENT DOCUMENTS

| | | | |
|---|---|---|---|
| JP | H04-031512 | A | 12/1997 |
| JP | H04-031512 | U | 12/1997 |
| JP | H09-313217 | A | 12/1997 |
| JP | 2003-526462 | A | 9/2003 |
| JP | 2003-533314 | A | 11/2003 |
| JP | 2006-522645 | A | 10/2006 |
| KR | 100724241 | B1 | 5/2007 |

OTHER PUBLICATIONS

Office Action, Japanese Patent Application No. 2018-169831, dated Jul. 16, 2019, 10 pages.

* cited by examiner

FASTENING TAPE WITH REINFORCED HOOKS

REFERENCE TO RELATED APPLICATION

This application claims the benefit of U.S. Provisional Application No. 62/561,805, filed Sep. 22, 2017 and entitled HOOK FASTENER, the content of which is hereby incorporated by reference in its entirety.

FIELD OF THE INVENTION

This application relates to fastening tape, and more particularly to fastening tape with reinforced hooks.

BACKGROUND

The manufacturing of fastening tape is difficult when a rigid polymer such as polyvinyl chloride (PVC) is utilized, especially when hooks of the fastening tape have a height of up to about 0.50 mm (referred to herein as "micro-hooks"). In particular, when the fastening tape is peeled out of a forming die, the hooks can become cracked or delaminated from a base of the fastening tape due to the force applied to the hooks. Such cracking or delamination significantly reduces the usability of the fastening tapes and may make them unsuitable for various applications. Therefore, there is a need for fastening tapes, and particularly fastening tapes with micro-hooks, with reduced cracking or delamination during manufacturing.

SUMMARY

The terms "invention," "the invention," "this invention" and "the present invention" used in this patent are intended to refer broadly to all of the subject matter of this patent and the patent claims below. Statements containing these terms should be understood not to limit the subject matter described herein or to limit the meaning or scope of the patent claims below. Embodiments of the invention covered by this patent are defined by the claims below, not this summary. This summary is a high-level overview of various embodiments of the invention and introduces some of the concepts that are further described in the Detailed Description section below. This summary is not intended to identify key or essential features of the claimed subject matter, nor is it intended to be used in isolation to determine the scope of the claimed subject matter. The subject matter should be understood by reference to appropriate portions of the entire specification of this patent, any or all drawings, and each claim.

According to various examples, a fastening tape includes a base, at least one hook, and at least one rib. The at least one hook projects from the base and includes a stem and an engagement portion extending from an upper end of the stem in a longitudinal direction. The stem includes a leading edge and a trailing edge in the longitudinal direction, and a center of the at least one hook is between the leading edge and the trailing edge. The at least one rib projects from the base laterally adjacent to the at least one hook, and a height of the at least one rib is less than a height of the at least one hook. A center of the at least one rib is offset from the center of the at least one hook in the longitudinal direction towards the leading edge of the stem.

According to certain examples, a fastening tape includes a base, a plurality of hook rows, and a plurality of rib rows. The plurality of hook rows extend in a longitudinal direction, and each hook row includes a plurality of hooks, each hook projecting from the base. The plurality of rib rows extend in the longitudinal direction. Each rib row includes a plurality of ribs projecting from the base. A height of the ribs is less than the height of the hooks, and at least one rib of the plurality of ribs is laterally adjacent to at least one hook of the plurality of hooks such that a center of the at least one rib is offset from a center of the at least one hook in the longitudinal direction.

According to some examples, a fastening tape includes a base, at least one hook, and at least one rib. The at least one hook projects from the base and includes a stem and an engagement portion extending from an upper end of the stem in a longitudinal direction. The stem includes a leading edge and a trailing edge in the longitudinal direction, and a length of the at least one hook is a distance from the leading edge to the trailing edge at the base. The at least one rib projects from the base at a position laterally adjacent to the at least one hook. A height of the at least one rib is less than a height of the at least one hook, a length of the at least one rib is less than the length of the at least one hook, and the at least one rib at least partially overlaps the leading edge of the at least one hook.

Various implementations described in the present disclosure can include additional systems, methods, features, and advantages, which cannot necessarily be expressly disclosed herein but will be apparent to one of ordinary skill in the art upon examination of the following detailed description and accompanying drawings. It is intended that all such systems, methods, features, and advantages be included within the present disclosure and protected by the accompanying claims.

BRIEF DESCRIPTION OF THE DRAWINGS

The features and components of the following figures are illustrated to emphasize the general principles of the present disclosure. Corresponding features and components throughout the figures can be designated by matching reference characters for the sake of consistency and clarity.

DETAILED DESCRIPTION

Figure 1:
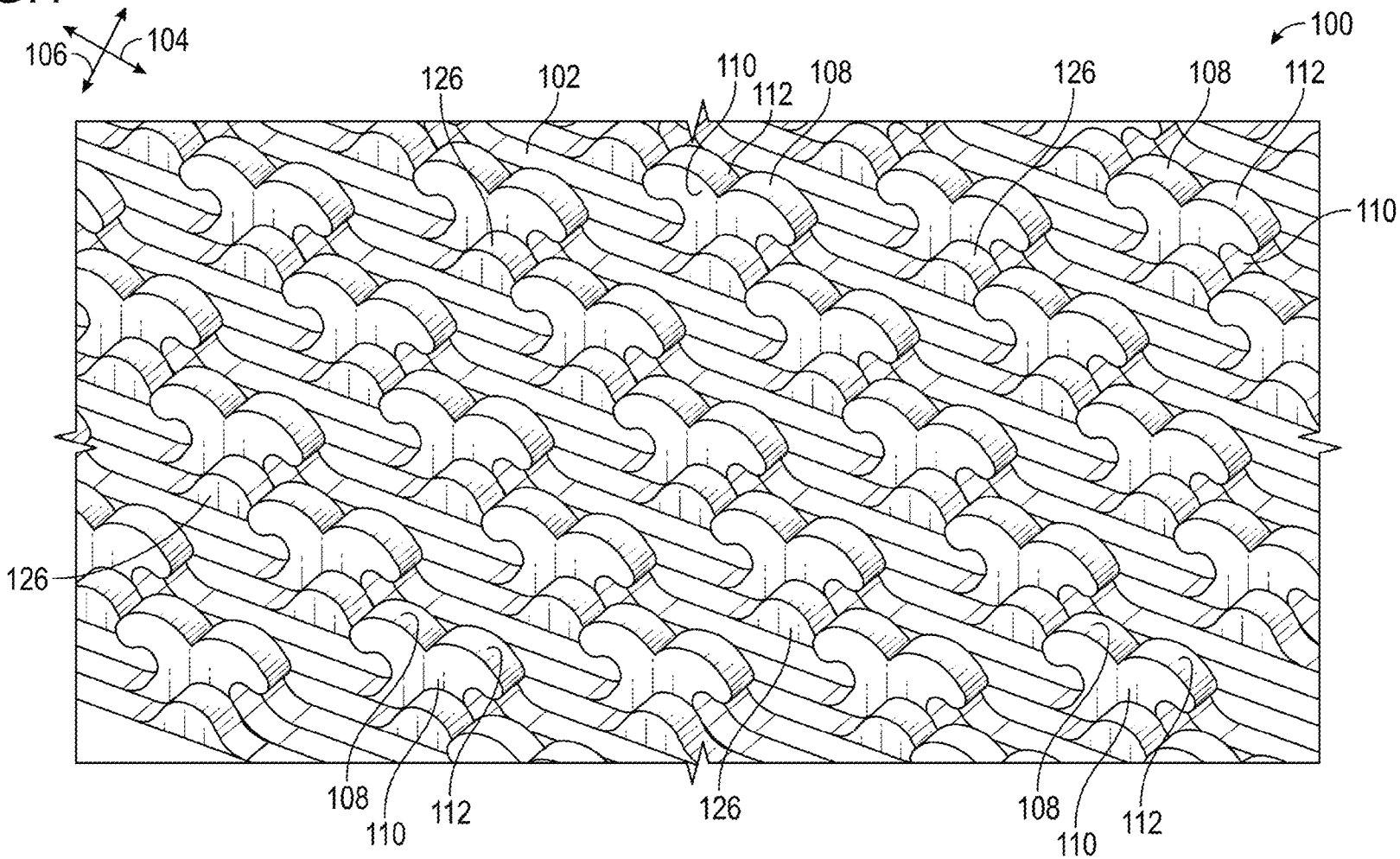
FIG. 1 is a perspective view of a fastening tape according to aspects of the current disclosure.

The subject matter of embodiments of the present invention is described here with specificity to meet statutory requirements, but this description is not necessarily intended to limit the scope of the claims. The claimed subject matter may be embodied in other ways, may include different elements or steps, and may be used in conjunction with other existing or future technologies. This description should not be interpreted as implying any particular order or arrangement among or between various steps or elements except when the order of individual steps or arrangement of elements is explicitly described. Directional references such as "leading," "trailing," "up," "down," "top," "left," "right,"

"front," and "back," among others, are intended to refer to the orientation as illustrated and described in the figure (or figures) to which the components and directions are referencing.

FIGS. 1-7 illustrate an example of an improved fastening tape 100 with improved strength and stability that minimizes hook deformation during the forming process. The fastening tape 100 includes a base 102 that has a longitudinal direction 104 and a lateral direction 106 extending transversely to the longitudinal direction 104. The fastening tape 100 also includes at least one hook 108 and at least one rib 126 extending from the base 102. In various examples, the at least one rib 126, the base 102, and at least one hook 108 are integrally or monolithically formed during a forming process.

In some examples, the fastening tape 100 includes a plurality of hooks 108. The plurality of hooks 108 may be arranged in various configurations on the base 102. For example, in some cases, the hooks 108 are arranged in one or more hook rows 146 (see FIG. 4) that extend in the longitudinal direction 104. In various examples, the hooks 108 of one hook row 146 may be aligned with the hooks of an adjacent hook row 146, although they need not be in other examples.

Figure 5:
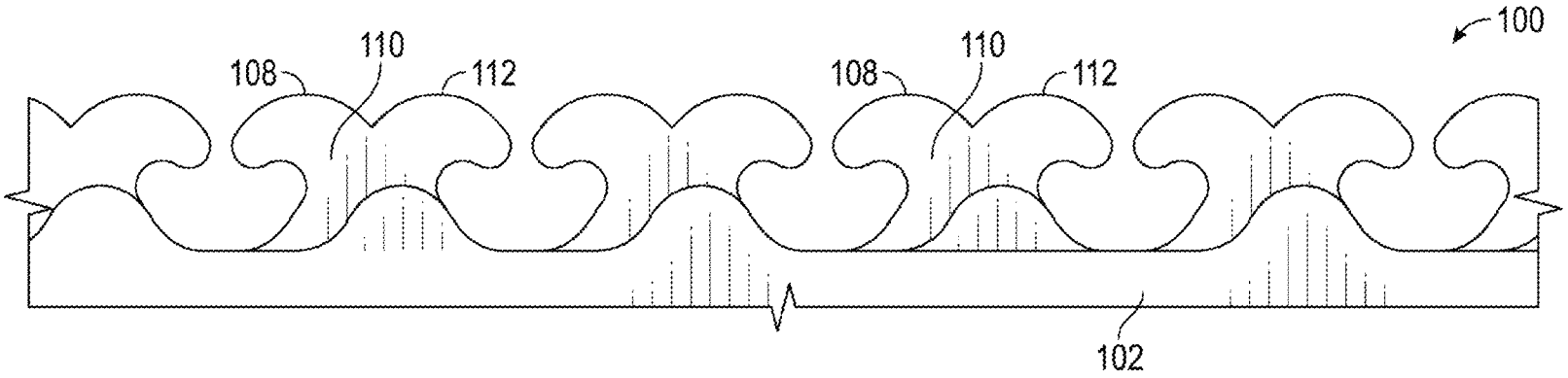
FIG. 5 is a side view of the fastening tape of FIG. 1.
Figure 6:
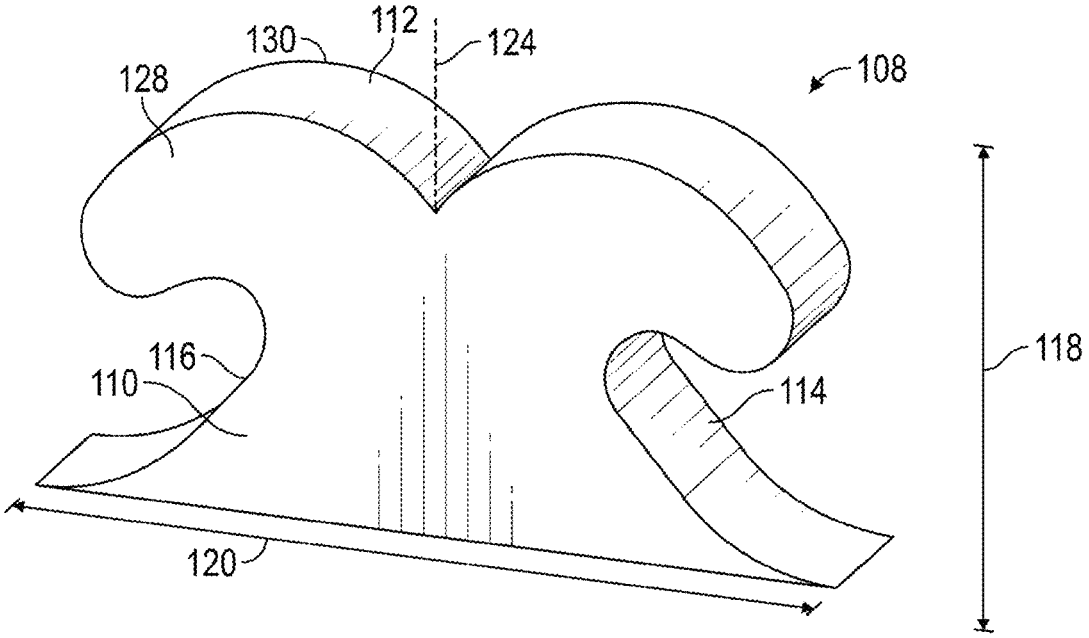
FIG. 6 is a perspective view of a hook of the fastening tape of FIG. 1.

As best illustrated in FIG. 6, each hook 108 includes a stem 110 and an engagement portion 112. The stem 110 includes a leading edge 114 and a trailing edge 116, and further includes opposing sides 128, 130 in the lateral direction 106. During manufacturing of the fastening tape 100, the leading edge 114 is the forward-most edge of the stem 110 in the manufacturing direction. The engagement portion 112 extends from an upper end of the stem 110 in the longitudinal direction 104. The engagement portion 112 may be various suitable types and/or shapes of engagement portions as desired. For example, in FIGS. 1-7, the engagement portion 112 is a Y-type engagement portion; however, in other examples, the engagement portion 112 may be a J-type engagement portion or various other suitable type and/or shape of engagement portion.

Referring to FIG. 6, each hook 108 has a height 118, which is a greatest distance that the hook 108 extends from the base 102. In some examples, each hook 108 is a "micro" hook, and the height 118 of each hook 108 is about 0.50 mm or less, such as about 0.05 mm, about 0.10 mm, about 0.15 mm, about 0.20 mm, about 0.25 mm, about 0.30 mm, about 0.35 mm, about 0.40 mm, about 0.45 mm, and/or about 0.50 mm. In other examples, the hook 108 may not be a micro hook, and the height 118 may be greater than 0.50 mm. In various examples, the height 118 of each hook 108 may be varied due to the forming process.

As illustrated in FIG. 6, a length 120 of each hook 108 is the distance between the leading edge 114 and the trailing edge 116 at a lowermost end of the hook 108. A center 124 of the hook 108 is about halfway between the leading edge 114 and the trailing edge 116. The length 120 of each hook 108 may be varied due to the forming process.

Figure 3:
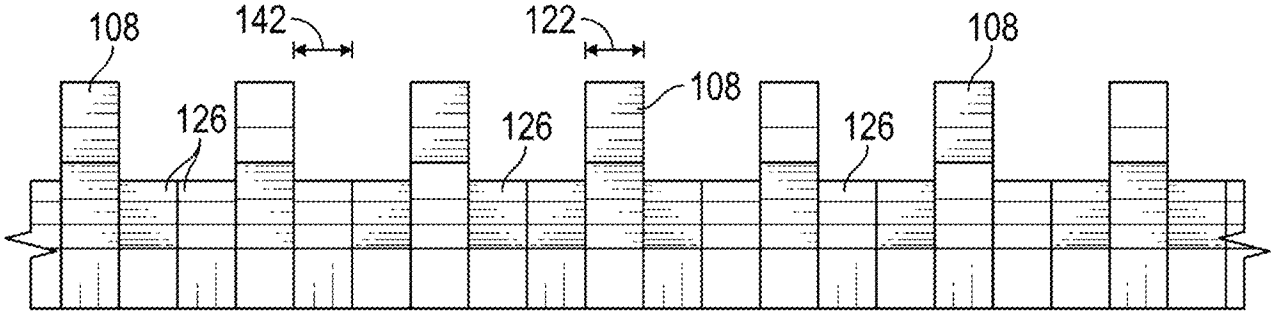
FIG. 3 is an end view of the fastening tape of FIG. 1.

Referring to FIG. 3, a width 122 of each hook 108 may be about 0.30 mm or less, such as about 0.05 mm, about 0.10 mm, about 0.15 mm, about 0.20 mm, about 0.25 mm, and/or about 0.30 mm. In other examples, the width 122 may be greater than about 0.30 mm. In certain aspects, the stem 110 is elongated in the longitudinal direction 104 such that the length 120 of each hook 108 is greater than the width 122. As one non-limiting example, the length 120 of the hook 108 may be about 0.73 mm and the width of the hook 108 may be about 0.15 mm. In other examples, various other lengths and widths may be utilized for each hook 108, and the length 120 and/or width 122 of each hook 108 may be varied due to the forming process.

Figure 2:
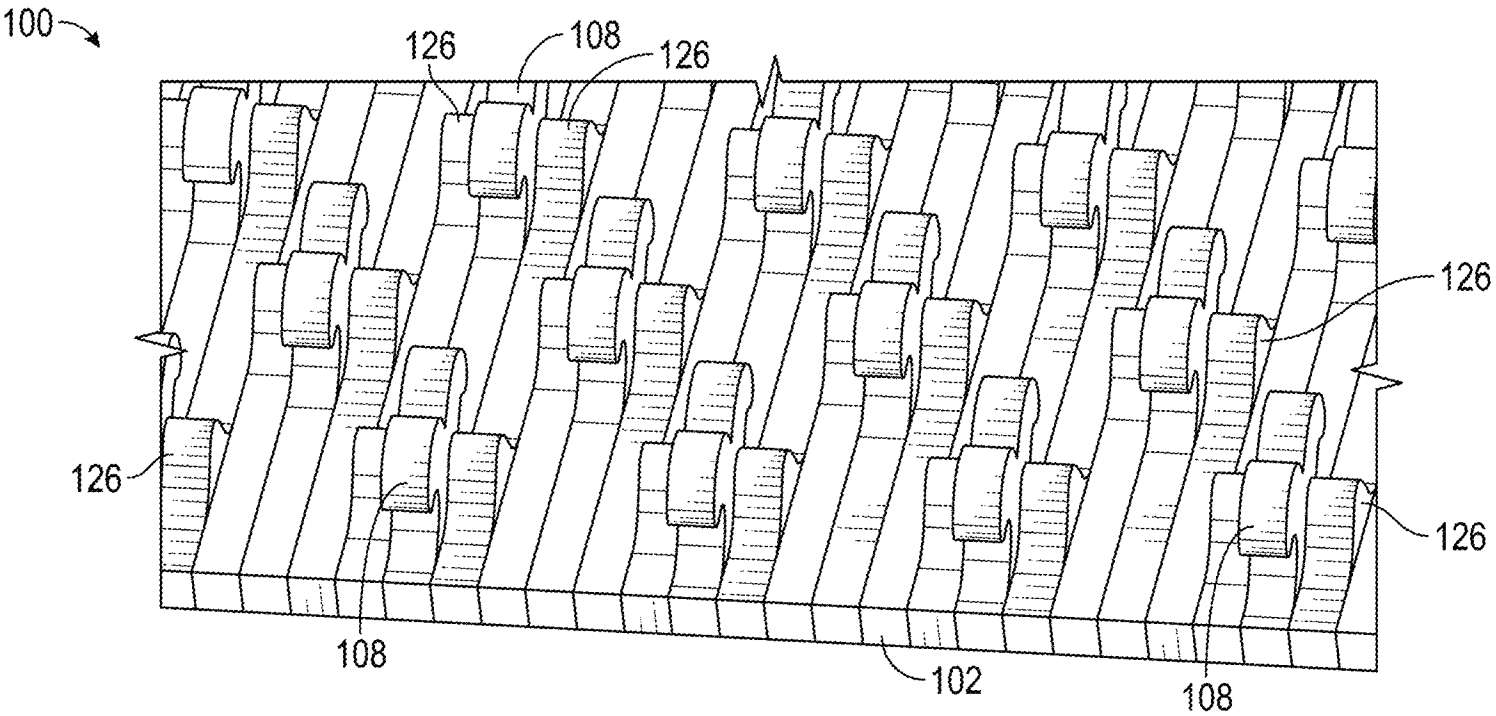
FIG. 2 is another perspective view of the fastening tape of FIG. 1.
Figure 4:
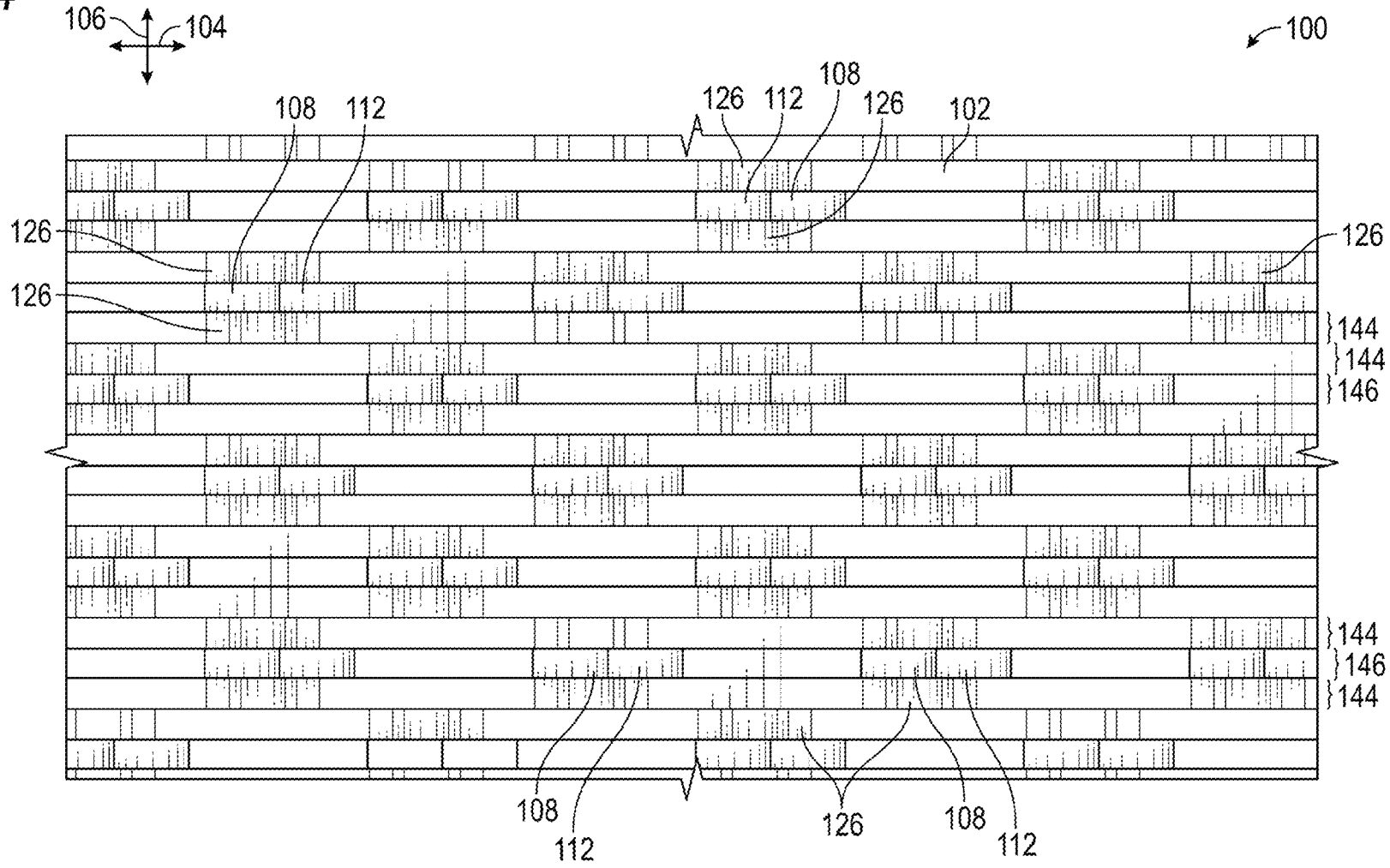
FIG. 4 is a top view of the fastening tape of FIG. 1.

As illustrated in FIGS. 1-5 and 7, the fastening tape 100 includes at least one rib 126 extending from the base 102. In some examples, the fastening tape 100 includes a plurality of ribs 126. The plurality of ribs 126 may be arranged in various configurations on the base 102. For example, in some cases, the ribs 126 are arranged in one or more rib rows 144 that extend in the longitudinal direction 104. As best illustrated in FIGS. 2-4, each rib 126 is monolithically or integrally formed with one of the hooks 108 at a position laterally adjacent to a corresponding hook 108. In various examples, a rib 126 is on one side of the hook 108 (i.e., on the side 128 or the side 130). In other examples, two ribs 126 are adjacent to a single hook 108 (i.e., one rib 126 is adjacent to one side 128 of the hook 108 and another rib 126 is adjacent to the other side 130 of the hook 108). In some examples, the ribs 126 of one rib row 144 are offset in the longitudinal direction 104 relative to the ribs 126 in another rib row 144. In some aspects, two rib rows 144 may be laterally adjacent to one another. In such examples, the ribs 126 in one rib row 144 may be aligned with or offset from the ribs 126 in the adjacent rib row 144.

In the example of FIGS. 1-5 and 7, an upper end portion of each rib 126 has a rounded profile, although in other examples, the ribs 126 may have various other profiles. Moreover, the profile of each rib 126 on the fastening tape 100 need not be the same. As such, the profile shape of the ribs 126 should not be considered limiting on the current disclosure.

Figure 7:
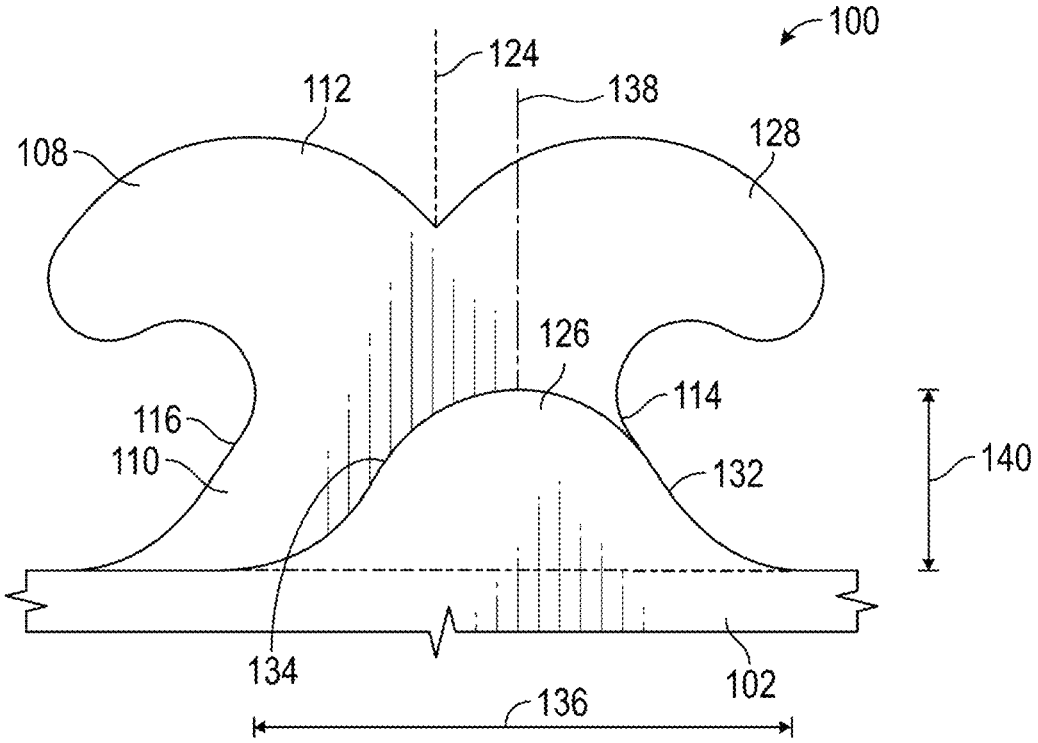
FIG. 7 is a side view of a hook and a rib of the fastening tape of FIG. 1.

Referring to FIG. 7, each rib 126 includes a leading edge 132 and a trailing edge 134. Similar to the hook 108, the leading edge 132 of the rib 126 is the forward-most edge of the rib 126 in the manufacturing direction during processing. A length 136 of the rib 126 is a distance from the leading edge 132 to the trailing edge 134 at the base 102. In some examples, the length 136 of the rib 126 is less than the length 120 of the hook 108. For example, in some examples, the length 136 of the rib 126 is from about one-half the length 120 of the hook 108 to about two-thirds the length 120 of the hook 108, although it need not be in other examples. As one non-limiting example, the length 120 may be about 0.73 mm and the length 136 may be from about 0.44 mm to about 0.46 mm. In other examples, the length 136 of the rib 126 may be greater than the length 120 of the hook 108 or approximately the length 120 of the hook. In certain cases, the length 136 may be any suitable length so long as the rib 126 at least partially overlaps the leading edge 114 of the hook 108. Optionally, the length 136 may be any suitable length so long as the rib 126 at least partially overlaps the leading edge 114 of the hook 108 while not overlapping the trailing edge 116 of the hook 108. In various examples, the length 136 of each rib 126 may be varied due to the forming process.

A center 138 of the rib 126 is between the leading edge 132 and the trailing edge 134. In some cases, the center 138 of the rib 126 is about halfway between the leading edge 132 and the trailing edge 134. As best illustrated in FIG. 7, in various examples, each rib 126 is provided such that the center 138 of the rib 126 is offset from the center 124 of the adjacent hook 108. In certain examples, the center 138 of the rib 126 is offset from the center 124 of the adjacent hook 108 in the forward direction towards the leading edge 114 of the hook 108. As best illustrated in FIGS. 1, 5, and 7, in some examples, each rib 126 at least partially overlaps a portion of the leading edge 114 of the adjacent hook 108. The sentence "each rib 126 at least partially overlaps a portion of the leading edge 114 of the adjacent hook 108" refers to a state where no difference in level in the lateral direction is formed between at least a part of the leading edge 132 of the rib 126 and a part of the leading edge 114 of the hook 108. In various aspects, the leading edge 132 of the rib 126 is substantially aligned with the leading edge 114 of the adjacent hook 108, although it need not be in other examples. For example, in other cases, the leading edge 132 of the rib 126 may be forward of the leading edge 114 of the hook 108 in the manufacturing direction such that the edges 114 and 132 are not aligned. As described in detail below, the rib 126 at least partially overlapping the leading edge 114 of the adjacent hook 108 may provide increased stability and strength to the stem 110 to minimize or reduce deformation or cracking of the stem 110 during processing. Additionally, the center 138 of the rib 126 being offset from the center 124 of the hook 108 may allow for the rib 126 to provide concentrated strength and stability to the leading edge 114 of the hook 108 while minimizing the amount of material needed to form the fastening tape 100.

Referring to FIG. 7, a height 140 of each rib 126, which is a greatest distance that the rib 126 extends from the base 102, is less than the height 118 of the adjacent hook 108. In certain cases, the height 140 is less than about one-half the height 118 of the adjacent hook 108, although it need not be. In one non-limiting example, the height 140 may be from about 0.14 mm to about 0.15 mm, although in other examples the height may be less than 0.14 mm and/or greater than about 0.15 mm. In certain aspects, the height 140 is a suitable height such that the rib 126 does not interfere with the engagement portion 112 during use of the fastening tape 100. Consequently, the rib 126 does not prevent loops from being hooked on the engagement portion 112. In various examples, the height 140 of each rib 126 may be varied due to the forming process.

As illustrated in FIG. 3, each rib 126 has a width 142. In some examples, the width 142 may be about 0.30 mm or less, such as about 0.10 mm, about 0.15 mm, about 0.20 mm, about 0.25 mm, and/or about 0.30 mm. In one non-limiting example, the width 142 is about 0.15 mm. In certain examples, the width 142 of a rib 126 is approximately the width 122 of the adjacent hook 108, although it need not be in other examples. The width 142 of each rib 126 may be varied due to the forming process.

Figure 8:
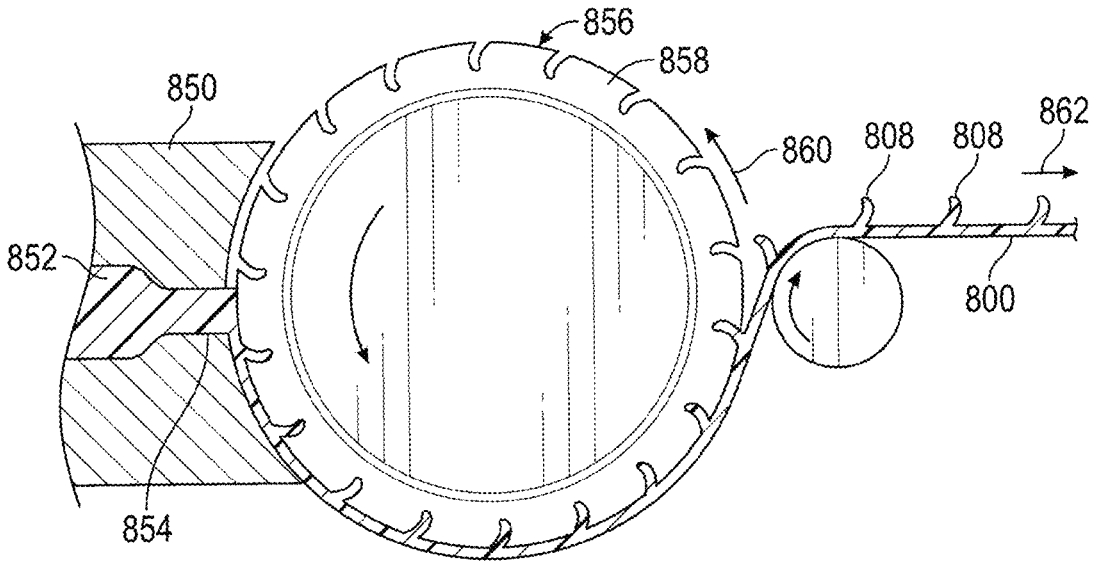
FIG. 8 illustrates a process for forming a fastening tape.

Referring to FIG. 8, a forming process for a fastening tape 800 with hooks 808 generally includes an extruder 850 that feeds resin 852 that forms the fastening tape 800 through a channel 854 such that the resin 852 flows over an outer surface 856 of a die wheel 858 as the die wheel 858 rotates (see arrow 860). As illustrated in FIG. 8, after the fastening tape 800 has formed on the die wheel 858, the fastening tape 800 is peeled off of the die wheel 858 while moving in the manufacturing direction (see arrow 862) for further processing. The peeling force needed to disengage the fastening tape 800 from the die wheel 858 commonly causes spoilage of some of the hooks 808 because the peeling force causes deformation, cracking, delamination, etc. at the leading edge of the hooks 808. Such spoilage is particularly common with micro hooks (i.e., hooks 808 having a height of about 0.50 mm or less) due to the dimensions of the micro hooks. As one non-limiting example, when forming a fastening tape with micro hooks, it may not be uncommon for about 30-40% of the hooks to be ruined due to cracking from the peeling force. It also many not be uncommon for percentage of micro hooks to be ruined due to deformation, etc. from the peeling force.

Compared to the hooks 808 without ribs, the hooks 108 of the fastening tape 100 are strengthened and stabilized during the forming process for forming the fastening tape 100. In particular, the rib 126 strengthens and improves the stability of the adjacent hook 108 because the center 138 of the rib 126 is offset in the forward direction (i.e., a direction of being likely to cause deformation, cracking, delamination, etc. by the peeling force) from the center 124 of the adjacent hook 108 and/or by the rib 126 at least partially overlaps the leading edge 114 of the adjacent hook 108. Such placement of the rib 126 better counteracts and resists the peeling force applied to the fastening tape 100 during the forming process, and deformation, cracking, etc. of the hook 108 is minimized or reduced, thereby producing a more durable fastening tape 100 compared to the fastening tape 800.

A collection of exemplary embodiments, including at least some explicitly enumerated as "ECs" (Example Combinations), providing additional description of a variety of embodiment types in accordance with the concepts described herein are provided below. These examples are not meant to be mutually exclusive, exhaustive, or restrictive; and the invention is not limited to these example embodiments but rather encompasses all possible modifications and variations within the scope of the issued claims and their equivalents.

EC 1. A fastening tape comprising: a base; at least one hook projecting from the base, wherein the at least one hook comprises a stem and an engagement portion extending from an upper end of the stem in a longitudinal direction, wherein the stem comprises a leading edge and a trailing edge in the longitudinal direction, and wherein a center of the at least one hook is between the leading edge and the trailing edge; and at least one rib projecting from the base laterally adjacent to the at least one hook, wherein a height of the at least one rib is less than a height of the at least one hook, and wherein a center of the at least one rib is offset from the center of the at least one hook in the longitudinal direction towards the leading edge of the stem.

EC 2. The fastening tape of any of the preceding or subsequent example combinations, wherein a height of the at least one hook is less than about 0.50 mm.

EC 3. The fastening tape of any of the preceding or subsequent example combinations, wherein a height of the at least one rib is from about 0.14 mm to about 0.15 mm.

EC 4. The fastening tape of any of the preceding or subsequent example combinations, wherein the at least one rib at least partially overlaps the leading edge of the stem in a lateral direction.

EC 5. The fastening tape of any of the preceding or subsequent example combinations, wherein a leading edge of the at least one rib is substantially aligned with the leading edge of the stem.

EC 6. The fastening tape of any of the preceding or subsequent example combinations, wherein the at least one rib is a first rib and is laterally adjacent to a first side of the at least one hook and wherein the fastening tape further comprises a second rib projecting from the base and laterally adjacent to a second side of the at least one hook opposite from the first rib, wherein a height of the second rib is less than the height of the at least one hook, and wherein a center of the second rib is offset from the center of the at least one hook in the longitudinal direction towards the leading edge of the stem.

EC 7. The fastening tape of any of the preceding or subsequent example combinations, wherein a leading edge of the first rib and a leading edge of the second rib at least partially overlap the leading edge of the stem.

EC 8. The fastening tape of any of the preceding or subsequent example combinations, wherein the leading edge of the first rib and the leading edge of the second rib are substantially aligned with the leading edge of the stem.

EC 9. The fastening tape of any of the preceding or subsequent example combinations, wherein a length of the at least one hook is a distance between the leading edge and the trailing edge of the stem at the base, and wherein a length of the at least one rib is less than a length of the at least one hook.

EC 10. The fastening tape of any of the preceding or subsequent example combinations, wherein the engagement portion comprises a Y-type engagement portion.

EC 11. A fastening tape comprising: a base; a plurality of hook rows extending in a longitudinal direction, wherein each hook row comprises a plurality of hooks, each hook projecting from the base; and a plurality of rib rows extending in the longitudinal direction, wherein each rib row comprises a plurality of ribs projecting from the base, wherein a height of the ribs is less than the height of the hooks, and wherein at least one rib of the plurality of ribs is laterally adjacent to at least one hook of the plurality of hooks such that a center of the at least one rib is offset from a center of the at least one hook in the longitudinal direction.

EC 12. The fastening tape of any of the preceding or subsequent example combinations, wherein the at least one hook comprises a leading edge and a trailing edge in the longitudinal direction, and wherein the center of the at least one rib is offset towards the leading edge of the at least one hook.

EC 13. The fastening tape of any of the preceding or subsequent example combinations, wherein the at least one rib comprises a leading edge and a trailing edge in the longitudinal direction, and wherein the leading edge of the at least one rib is substantially aligned with the leading edge of the at least one hook.

EC 14. The fastening tape of any of the preceding or subsequent example combinations, wherein each hook of the plurality of hooks comprises a stem projecting from the base and an engagement portion extending from an upper end of the stem in the longitudinal direction.

EC 15. The fastening tape of any of the preceding or subsequent example combinations, wherein at least one rib row is between a first hook row and a second hook row of the plurality of hook rows such that each rib of the at least one rib row is laterally adjacent to a corresponding hook of the first hook row and a center of each rib of the at least one rib row is offset from a center of the corresponding hook of the first hook row.

EC 16. The fastening tape of any of the preceding or subsequent example combinations, wherein each hook of the first hook row comprises a leading edge and a trailing edge, and wherein each rib of the at least one rib row at least partially overlaps the leading edge of the corresponding hook of the first hook row in a lateral direction.

EC 17. The fastening tape of any of the preceding or subsequent example combinations, wherein each rib of the at least one rib row comprises a leading edge and a trailing edge, and wherein the leading edge of each rib of the at least one rib row is substantially aligned with the leading edge of the corresponding hook of the first hook row.

EC 18. The fastening tape of any of the preceding or subsequent example combinations, where the at least one rib row is a first rib row, and wherein a second rib row of the plurality of rib rows is between the first hook row and the second hook row such that each rib of the second rib row is laterally adjacent to a corresponding hook of the second hook row and a center of each rib of the second rib row is offset from a center of the corresponding hook of the second rib row.

EC 19. The fastening tape of any of the preceding or subsequent example combinations, wherein the first rib row is between the second rib row and the first hook row, wherein the ribs of the first rib row are longitudinally offset from the ribs of the second rib row, and wherein the hooks of the first hook row are longitudinally offset from the hooks of the second hook row.

EC 20. The fastening tape of any of the preceding or subsequent example combinations, wherein a length of the at least one rib is less than a length of the at least one hook in the longitudinal direction.

EC 21. A fastening tape comprising: a base; at least one hook projecting from the base, wherein the at least one hook comprises a stem and an engagement portion extending from an upper end of the stem in a longitudinal direction, wherein the stem comprises a leading edge and a trailing edge in the longitudinal direction, and wherein a length of the at least one hook is a distance from the leading edge to the trailing edge at the base; and at least one rib projecting from the base laterally adjacent to the at least one hook, wherein a height of the at least one rib is less than a height of the at least one hook, wherein a length of the at least one rib is less than the length of the at least one hook, and wherein the at least one rib at least partially overlaps the leading edge of the at least one hook.

EC 22. The fastening tape of any of the preceding or subsequent example combinations, wherein a height of the at least one hook is less than about 0.50 mm.

EC 23. The fastening tape of any of the preceding or subsequent example combinations, wherein a height of the at least one rib is from about 0.14 mm to about 0.15 mm.

EC 24. The fastening tape of any of the preceding or subsequent example combinations, wherein a leading edge of the at least one rib is substantially aligned with the leading edge of the stem.

EC 25. The fastening tape of any of the preceding or subsequent example combinations, wherein a center of the at least one hook is between the leading edge and the trailing edge of the at least one hook, and wherein a center of the at least one rib is offset from the center of the at least one hook.

EC 26. The fastening tape of any of the preceding or subsequent example combinations, wherein the at least one rib is a first rib and is laterally adjacent to a first side of the at least one hook and wherein the fastening tape further comprises a second rib projecting from the base and laterally adjacent to a second side of the at least one hook opposite from the first rib, wherein a height of the second rib is less than the height of the at least one hook, and wherein a center of the second rib is offset from the center of the at least one hook in the longitudinal direction towards the leading edge of the stem.

EC 27. The fastening tape of any of the preceding or subsequent example combinations, wherein a leading edge of the first rib and a leading edge of the second rib at least partially overlap the leading edge of the stem.

EC 28. The fastening tape of any of the preceding or subsequent example combinations, wherein the leading edge of the first rib and the leading edge of the second rib are substantially aligned with the leading edge of the stem.

EC 29. The fastening tape of any of the preceding or subsequent example combinations, wherein a length of the at least one hook is a distance between the leading edge and the trailing edge of the stem at the base, and wherein a length of the at least one rib is less than a length of the at least one hook.

EC 30. The fastening tape of any of the preceding or subsequent example combinations, wherein the engagement portion comprises a Y-type engagement portion.

The above-described aspects are merely possible examples of implementations, merely set forth for a clear understanding of the principles of the present disclosure. Many variations and modifications can be made to the above-described embodiment(s) without departing substantially from the spirit and principles of the present disclosure. All such modifications and variations are intended to be included herein within the scope of the present disclosure, and all possible claims to individual aspects or combinations of elements or steps are intended to be supported by the present disclosure. Moreover, although specific terms are employed herein, as well as in the claims that follow, they are used only in a generic and descriptive sense, and not for the purposes of limiting the described invention, nor the claims that follow.

That which is claimed:

1. A fastening tape comprising:

a base that has a longitudinal direction and a lateral direction extending transversely to the longitudinal direction;

at least one hook projecting from the base, wherein the at least one hook comprises a stem and an engagement portion extending from an upper end of the stem in the longitudinal direction, wherein the stem comprises a leading edge and a trailing edge in the longitudinal direction, wherein the engagement portion extends toward both the leading edge and the trailing edge in the longitudinal direction to form a Y-shape, and wherein a center of the at least one hook in the longitudinal direction is between the leading edge and the trailing edge; and at least one rib projecting from the base laterally adjacent to the at least one hook, wherein a center of the at least one rib in the longitudinal direction is longitudinally offset from the center of the at least one hook in the longitudinal direction towards the leading edge of the stem at a top of the at least one rib, wherein a height of the at least one hook is less than 0.50 mm, and wherein a height of the at least one rib is less than one-half the height of the at least one hook and is from 0.14 mm to 0.15 mm, wherein the at least one rib is in an overlapping state where the at least one rib overlaps the leading edge of the stem without overlapping the trailing edge of the stem, wherein the overlapping state is a state where no difference in level in the lateral direction is formed between a leading edge of the at least one rib and the leading edge of the stem of the at least one hook, and wherein a length from the leading edge to a trailing edge of the at least one rib is less than a length between the leading edge and the trailing edge of the stem of the at least one hook.

2. The fastening tape of claim 1, wherein the at least one rib at least partially overlaps the leading edge of the stem in a lateral direction.

3. The fastening tape of claim 2, wherein a leading edge of the at least one rib is substantially aligned with the leading edge of the stem.

4. The fastening tape of claim 1, wherein the at least one rib is a first rib and is laterally adjacent to a first side of the at least one hook and wherein the fastening tape further comprises a second rib projecting from the base and laterally adjacent to a second side of the at least one hook opposite from the first rib, wherein a height of the second rib is less than the height of the at least one hook, and wherein a center of the second rib in the longitudinal direction is longitudinally offset from the center of the at least one hook in the longitudinal direction towards the leading edge of the stem.

5. The fastening tape of claim 4, wherein a leading edge of the first rib and a leading edge of the second rib at least partially overlap the leading edge of the stem.

6. The fastening tape of claim 5, wherein the leading edge of the first rib and the leading edge of the second rib are substantially aligned with the leading edge of the stem.

7. A fastening tape comprising:

a base that has a longitudinal direction and a lateral direction extending transversely to the longitudinal direction;

a plurality of hook rows extending in the longitudinal direction, wherein each hook row of the plurality of hook rows comprises a plurality of hooks, each hook of the plurality of hooks projecting from the base, wherein each hook of the plurality of hooks comprises an engagement portion extending from an upper end thereof in the longitudinal direction, and wherein the engagement portion extends in the longitudinal direction to form a Y-shape; and a plurality of rib rows extending in the longitudinal direction, wherein each rib row of the plurality of rib rows comprises a plurality of ribs projecting from the base, and wherein at least one rib of the plurality of ribs is laterally adjacent to at least one hook of the plurality of hooks such that a center of the at least one rib in the longitudinal direction is longitudinally offset from a center of the at least one hook in the longitudinal direction at a top of the at least one rib, wherein a height of each hook of the plurality of hooks is less than 0.50 mm, and wherein a height of each rib of the plurality of ribs is less than one-half the height of each hook of the plurality of hooks and is from 0.14 mm to 0.15 mm, wherein the at least one rib is in an overlapping state where the at least one rib overlaps a leading edge of a stem of the at least one hook without overlapping a trailing edge of the stem, wherein the overlapping state is a state where no difference in level in the lateral direction is formed between a leading edge of the at least one rib and the leading edge of the stem of the at least one hook, and wherein a length from the leading edge to a trailing edge of the at least one rib is less than a length between the leading edge and the trailing edge of the stem of the at least one hook.

8. The fastening tape of claim 7, wherein the at least one hook comprises the leading edge and the trailing edge in the longitudinal direction, and wherein the center of the at least one rib in the longitudinal direction is offset towards the leading edge of the at least one hook.

9. The fastening tape of claim 8, wherein the at least one rib comprises the leading edge and the trailing edge in the longitudinal direction, and wherein the leading edge of the at least one rib is substantially aligned with the leading edge of the at least one hook.

10. The fastening tape of claim 7, wherein at least one rib row of the plurality of rib rows is between a first hook row and a second hook row of the plurality of hook rows such that each rib of the at least one rib row is laterally adjacent to a corresponding hook of the first hook row and a center of each rib of the at least one rib row in the longitudinal direction is longitudinally offset from a center of the corresponding hook of the first hook row.

11. The fastening tape of claim 10, wherein each hook of the first hook row comprises the leading edge and the trailing edge, and wherein each rib of the at least one rib row at least partially overlaps the leading edge of the corresponding hook of the first hook row in the lateral direction.

12. The fastening tape of claim 11, wherein each rib of the at least one rib row comprises the leading edge and the trailing edge, and wherein the leading edge of each rib of the at least one rib row is substantially aligned with the leading edge of the corresponding hook of the first hook row.

13. The fastening tape of claim 10, wherein the at least one rib row is a first rib row, wherein a second rib row of the plurality of rib rows is between the first hook row and the second hook row such that each rib of the second rib row is laterally adjacent to a corresponding hook of the second hook row and a center of each rib of the second rib row in the longitudinal direction is longitudinally offset from a center of the corresponding hook of the second hook row in the longitudinal direction, wherein the first rib row is between the second rib row and the first hook row, and wherein the ribs of the first rib row are longitudinally offset from the ribs of the second rib row, and wherein the hooks of the first hook row are longitudinally offset from the hooks of the second hook row.

* * * * *